US005726130A

United States Patent [19]

Yamanaka

[11] Patent Number: 5,726,130

[45] Date of Patent: Mar. 10, 1998

[54] CUTTING OR GRINDING OIL COMPOSITION

[75] Inventor: Masami Yamanaka, Ichihara, Japan

[73] Assignee: Idemitsu Kosan Co., Ltd., Tokyo, Japan

[21] Appl. No.: 737,584

[22] PCT Filed: May 23, 1995

[86] PCT No.: PCT/JP95/00985

§ 371 Date: Nov. 19, 1996

§ 102(e) Date: Nov. 19, 1996

[87] PCT Pub. No.: WO95/32267

PCT Pub. Date: Nov. 30, 1995

[30] Foreign Application Priority Data

May 24, 1994 [JP] Japan ..... 6-109770

[51] Int. Cl.[6] ..... C10M 125/22; C10M 129/26; C10M 129/72

[52] U.S. Cl. ..... 508/152; 508/153; 508/398; 508/400; 72/42

[58] Field of Search ..... 508/398, 400, 508/152, 153, 326, 331, 336, 345, 465, 506; 72/42

[56] References Cited

U.S. PATENT DOCUMENTS

| | | | |
|---|---|---|---|
| 2,279,688 | 4/1942 | Larsen | 508/331 |
| 2,459,717 | 1/1949 | Perry | 508/331 |
| 2,481,372 | 9/1949 | von Fuchs | 508/331 |
| 2,775,560 | 12/1956 | Lurton et al. | 508/331 |
| 4,072,618 | 2/1978 | Andress, Jr. | 508/345 |
| 4,560,488 | 12/1985 | Vinci | 508/331 |
| 5,104,558 | 4/1992 | Matsuzaki | 508/345 |
| 5,308,654 | 5/1994 | Nage et al. | 508/345 |
| 5,360,565 | 11/1994 | Junga | 508/331 |

OTHER PUBLICATIONS

JP–346085 Abstract 20 Dec. 1994.

JP–346,086 Absract 20 Dec. 1994.

*Primary Examiner*—Margaret Medley

*Attorney, Agent, or Firm*—Oblon, Spivak, McClelland, Maier & Neustadt, P.C.

[57] ABSTRACT

A cutting or grinding oil composition comprising (A) a base oil and (B) at least one compound selected from the group consisting of dibasic acids having 2 to 6 carbon atoms, tribasic acids having 3 to 6 carbon atoms, and ester derivatives of these acids; and a cutting or grinding oil composition comprising component (A) described above, component (B) described above, (C) a compound containing sulfur, and/or (D) at least one compound selected from the group consisting of perbasic alkali metal sulfonates and perbasic alkaline earth metal sulfonates are disclosed. By using the oil composition, increase in working efficiency, such as suppressed wear of working tools and superior precision of a finished surface, can be achieved.

10 Claims, No Drawings

CUTTING OR GRINDING OIL COMPOSITION

TECHNICAL FIELD

The present invention relates to a cutting or grinding oil composition. More particularly, the present invention relates to a cutting or grinding oil composition which increases working efficiency, such as suppressed wear of working tools and superior precision of a finished surface, and advantageously used as an oil for working by cutting, such as turning, tapping, reaming, broaching, drilling, or automatic lathe working.

BACKGROUND ART

In working of metals, working by cutting in which cutting tools, such as bits, milling cutters, and drills, are used and relatively rough wastes are formed and working by grinding in which grinds rotating in a high speed are used and very fine wastes are formed are frequently conducted.

To cutting oils and grinding oils insoluble in water which are used for working of metals described above, various types of extreme pressure agent and various types of oiliness improver are heretofore added for the purpose of improving workability. However, in the industries using oil compositions for working of metals, oil compositions which enables further improvement of workability are desired for increasing productivity and saving energy.

As the cutting oil and the grinding oil which are intended to satisfy the above requirement, cutting oils and grinding oils containing a base oil and a sulfur-containing extreme pressure agent or a chlorine-containing extreme pressure agent are commercially available. However, these cutting oils and grinding oils do not sufficiently satisfy the requirements with respect to wear of tools and precision of the finished surface which are major factors affecting the efficiency of working. Moreover, when an oil composition contains a sulfur-containing extreme pressure agent or a chlorine-containing extreme pressure agent, environmental problems may arise because chlorine gas or $SO_x$ is formed when the used oil composition is disposed.

DISCLOSURE OF THE INVENTION

Under the above circumstances, the present invention has an object of providing a cutting or grinding oil composition which does not contain a sulfur-containing extreme pressure agent or a chlorine-containing extreme pressure agent and can achieve increase in working efficiency, such as suppressed wear of working tools and superior precision of a finished surface, and another object of providing a cutting or grinding oil composition which can achieve further improvement in workability of conventional oil compositions containing a sulfur-containing extreme pressure agent or a chlorine-containing extreme pressure agent.

The present inventors conducted extensive studies to develop a cutting or grinding oil composition having the above advantageous properties. As the result of such studies, it was discovered that the above objects can be achieved by a composition comprising a base oil and a specific polybasic acid or an ester derivative thereof, and by a composition comprising a compound containing sulfur or a perbasic sulfonate in addition to the above components. The present invention has been completed on the basis of the discovery.

Thus, the present invention provides: a cutting or grinding oil composition comprising (A) a base oil and (B) at least one compound selected from the group consisting of dibasic acids having 2 to 6 carbon atoms, tribasic acids having 3 to 6 carbon atoms, and ester derivatives of these acids; a cutting or grinding oil composition comprising component (A) described above, component (B) described above, and (C) a compound containing sulfur; a cutting or grinding oil composition comprising component (A) described above, component (B) described above, and (D) (D) at least one compound selected from the group consisting of perbasic alkali metal sulfonates and perbasic alkaline earth metal sulfonates; and a cutting or grinding oil composition comprising component (A) described above, component (B) described above, component (C) described above, and component (D) described above.

THE MOST PREFERRED EMBODIMENT TO CARRY OUT THE INVENTION

As the base oil of component (A) in the cutting or grinding oil composition of the present invention, a mineral oil (such as a paraffinic, naphthenic, or intermediate mineral oil) or a synthetic oil is used. An oil having a kinematic viscosity in the range of 1.5 to 50 cSt at the temperature of 40° C. is particularly preferable. When the kinematic viscosity is lower than 1.5 cSt, the oil has a low flash point, and there is the possibility that fire is caused or the working environment is deteriorated by mist of the oil. When the kinematic viscosity is higher than 50 cSt, the amount of the oil composition which is attached to a work (an article for working) and carried away therewith increases, and the oil composition is economically disadvantageous. Accordingly, such a kinematic viscosity is not preferable. In view of the flash point, the working environment, and the economy, a kinematic viscosity in the range of 5 to 30 cSt at the temperature of 40° C. is more preferable.

As the mineral oil, various types of mineral oil can be used. Examples of the mineral oil include distillates obtained by the atmospheric distillation of paraffinic crude oils, intermediate crude oils, and naphthenic crude oils, distillates obtained by vacuum distillation of residue oils of the atmospheric distillation, and purified oils obtained by purifying the above distillates by a conventional method, such as oils purified with a solvent, oils purified by hydrogenation, oils treated by dewaxing, and oils treated by white clay.

Examples of the synthetic oil include branched olefins, such as oligomers of α-olefins, copolymers of olefins, polybutene, and polypropylene, hydrogenation products of these branched olefins, polyol esters, and alkylbenzenes.

In the present invention, as the base oil of component (A), the above mineral oil may be used singly or as a combination of two or more types. The above synthetic oil may also be used as the base oil of component (A) singly or as a combination of two or more types. A combination of one or more types of the mineral oil and one or more types of the synthetic oil may be used as well.

When a base oil having a relatively low viscosity, such as a kinematic viscosity of about 10 cSt or less at the temperature of 40° C., is used, it is preferred that a macromolecular compound, such as a polymethacrylate, polyisobutylene, and a copolymer of an olefin, having a number-average molecular weight of about 2,000 to 300,000 is added to the base oil. The formation of mist during the working can be decreased by adding the macromolecular compound. The added amount of the above macromolecular compound is different depending on the properties of the base oil and the molecular weight of the macromolecular compound and cannot invariably be determined. The amount is generally in the range of 0.05 to 20% by weight, preferably in the range of 0.1 to 5% by weight, based on the total amount of the composition.

In the composition of the present invention, a dibasic carboxylic acid having 2 to 6 carbon atoms, a tribasic carboxylic acid having 3 to 6 carbon atoms, and/or an ester derivative of the dibasic acid or tribasic acid is used as component (B). The dibasic acid and tribasic acid may have a hydroxyl group or an unsaturated group.

As the dibasic acid having 2 to 6 carbon atoms, various dibasic acids can be used. Examples of the dibasic acid include oxalic acid, malonic acid, hydroxymalonic acid, succinic acid, α-hydroxysuccinic acid, glutaric acid, adipic acid, malic acids (racemic, D-, and L-malic acids), maleic acid, fumaric acid, muconic acids (cis-trans-, trans-trans-, and cis-cis-muconic acids), and tartaric acids (racemic, D-, L-, and meso-tartaric acids). As the tribasic acid having 3 to 6 carbon atoms, various tribasic acids can be used. Examples of the tribasic acid include citric acid and aconitic acids (cis- and trans-aconitic acids). Among these polybasic acids (the dibasic acids and the tribasic acids), oxalic acid, malonic acid, succinic acid, maleic acid, fumaric acid, tartaric acids (racemic, D-, L-, and meso-tartaric acids), and citric acids are preferable, and oxalic acid, maleic acid, and citric acid are more preferable.

As the ester derivative of the above polybasic acid (the dibasic acid and the tribasic acid), various ester derivatives, such as complete esters and partial esters, can be used. Examples of the preferred ester derivative of the polybasic acid include esters of dibasic acids represented by the following general formula (I) (such as esters of oxalic acid, esters of malonic acid, and esters of succinic acid), esters of maleic acid represented by the following general formula (II), esters of fumaric acid represented by the following general formula (III), esters of tartaric acid represented by the general formula (IV), and esters of citric acid represented by the following general formula (V):

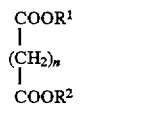
(I)

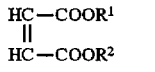
(II)

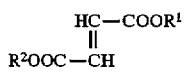
(III)

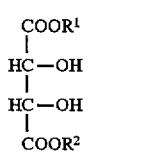
(IV)

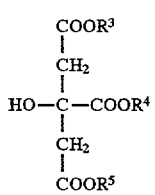
(V)

In the above general formulae (I) to (IV), at least one of $R^1$ and $R^2$represents a linear saturated or unsaturated aliphatic hydrocarbon group having 1 to 20 carbon atoms, a branched saturated or unsaturated aliphatic hydrocarbon group, or a saturated or unsaturated alicyclic hydrocarbon group, and the rest of $R^1$ and $R^2$, if any, represents hydrogen atom. When $R^1$ and $R^2$ represent both aliphatic hydrocarbon groups, the aliphatic hydrocarbon groups may be the same or different. In the general formula (I), n represents 0 or an integer of 1 to 4. In the general formula (V), at least one of $R^3$, $R^4$, and $R^5$ represents an aliphatic hydrocarbon group having 1 to 20 carbon atoms, and the rest of $R^3$, $R^4$, and $R^5$, if any, represent hydrogen atom. When two or three of $R^3$, $R^4$, and $R^5$ represent aliphatic hydrocarbon groups, the aliphatic hydrocarbon groups may be the same with each other or different from each other.

Specific examples of the above aliphatic hydrocarbon group having 1 to 20 carbon atoms (the alcohol residue group) include methyl group, ethyl group, n-propyl group, isopropyl group, n-butyl group, isobutyl group, sec-butyl group, t-butyl group, various types of pentyl group, various types of hexyl group, various types of heptyl group, various types of octyl group, various types of nonyl group, various types of decyl group, various types of undecyl group, various types of dodecyl group, various types of tridecyl group, various types of tetradecyl group, various types of pentadecyl group, various types of hexadecyl group, various types of heptadecyl group, various types of octadecyl group (including oleyl group), cyclohexyl group, cyclooctyl group, and cyclododecyl group.

Particularly when the solubility into the base oil and the effect are taken into consideration, the alcohol residue groups having 3 to 10 carbon atoms are preferable.

Specific examples of the ester of a dibasic acid represented by the above general formula (I) include diethyl oxalate, di-n-propyl oxalate, diisopropyl oxalate, di-n-butyl oxalate, diisobutyl oxalate, di-n-octyl oxalate, diethyl malonate, di-n-propyl malehate, diisopropyl malonate, di-n-butyl malonate, diisobutyl malonate, diethyl succinate, di-n-propyl succinate, diisopropyl succinate, di-n-butyl succinate, diisobutyl succinate, and monoesters corresponding to these diesters.

Specific examples of the ester of maleic acid and the ester of fumaric acid represented by the general formula (II) and (III), respectively, include diethyl maleate, di-n-propyl maleate, diisopropyl maleate, di-n-butyl maleate, diisobutyl maleate, diethyl fumarate, di-n-propyl fumarate, diisopropyl fumarate, di-n-butyl fumarate, diisobutyl fumarate, and monoesters corresponding to these diesters.

Specific examples of the ester of tartaric acid represented by the general formula (IV) include diethyl tartrates (racemic, D-, L-, and meso-diethyl tartrates), di-n-propyl tartrates (racemic, D-, L-, and meso-di-n-propyl tartrates), diisopropyl tartrates (racemic, D-, L-, and meso-diisopropyl tartrates), di-n-butyl tartrates (racemic, D-, L-, and meso-di-n-butyl tartrates), diisobutyl tartrates (racemic, D-, L-, and meso-diisobutyl tartrates), di-n-octyl tartrates (racemic, D-, L-, and meso-di-n-octyl tartrates), and monoesters corresponding to these diesters. Specific examples of the ester of citric acid represented by the general formula (V) include tri-n-butyl citrate, triisobutyl citrate, tri-n-octyl citrate, monoesters corresponding to these triesters, and diesters corresponding these triesters.

In the present invention, the above polybasic acids (such as the dibasic acids and the tribasic acids) and the ester derivatives thereof may be used for component (B) singly or as a combination of two or more types.

When the above polybasic acid, such as the dibasic acid and the tribasic acid, is used as component (B), the content is generally selected in the range of 0.05 to 20% by weight, preferably in the range of 0.1 to 10% by weight, based on the total amount of the composition. When the content is less than 0.05% by weight, the effect of increasing the working efficiency is insufficient. When the content is more than 2% by weight, the solubility into the base oil is decreased. Moreover, the effect is not increased to the degree expected from the content, and an economic disadvantage is caused in view of the cost.

When the above polybasic acid is not easily dissolved into the base oil by directly adding the acid to the base oil, the polybasic acid can be added after being dissolved in a suitable solvent, for example, an alcohol such as oleyl alcohol and a mixture of alcohols having 13 carbon atoms and alcohols having 14 carbon atoms, a carbinol such as butyl carbinol, or a cellosolve such as butyl cellosolve, in advance.

As the polybasic acid or the ester derivative for component (B), oxalic acid, maleic acid, citric acid, and esters of these acids are preferable because the efficiency of working is increased by the easier reaction with metals.

When the ester derivative of the above polybasic acid is used as component (B), the content is generally selected in the range of 0.05 to 80% by weight, preferably in the range of 0.1 to 50% by weight, based on the total amount of the composition. When the content is less than 0.05% by weight, the effect of increasing the working efficiency is insufficient. When the content is more than 80 % by weight, the effect is not increased to the degree expected from the content, and the economic disadvantage is caused in view of the cost.

When the acid or alcohol residue group of the ester derivative of the polybasic acid has a small number of carbon atom, the ester derivative has a low solubility in the base oil. Therefore, it is preferred that the above ester derivative is added to the base oil after being dissolved in a suitable solvent, for example, an alcohol such as oleyl alcohol and a mixture of alcohols having 13 carbon atoms and alcohols having 14 carbon atoms, a carbinol such as butyl carbinol, and a cellosolve such as butyl cellosolve, in advance.

As described above, component (B) of the present invention is used in the form of an acid or an ester, and the object of the present invention can be achieved by using either form. Among these forms, an ester is preferable in view of the solubility and the prevention of corrosion.

In the cutting or grinding oil composition of the present invention, a compound containing sulfur may be comprised as component (C), where desired, in combination with component (A) and component (B) described above. When the oil composition comprises component (C), the working efficiency is further increased by the synergistic effect or the additive effect with component (B). As component (C), for example, (1) elemental sulfur, (2) an olefin polysulfide, (3) a dialkyl polysulfide, (4) a sulfurized oil and fat, and (5) a sulfurized mineral oil can be used. The above substances may be used singly or as a combination of two or more types.

When elemental sulfur (1) is used as component (C), the content is selected generally in the range of 0.05 to 2% by weight, preferably in the range of 0.1 to 1% by weight, based on the total amount of the composition. When the content is less than 0.05% by weight, the synergistic effect or the additive effect is not sufficiently exhibited. When the content is more than 2% by weight, the stability after the sulfurization is inferior, and the tendency to precipitate sulfur arises.

When elemental sulfur is used, it is advantageous that elemental sulfur is added to the base oil and dissolved therein by heating at a temperature of about 120 to 150° C. for about 30 minutes to 6 hours while being stirred, and other ingredients are added to the resultant solution.

The above olefin polysulfide (2) is a compound obtained by bringing an olefin having 3 to 20 carbon atoms or a dimer, a trimer, or a tetramer thereof into reaction with a sulfurizing agent, more specifically, sulfur, sulfur chloride, or a sulfur halide of another type. As the olefin, for example, propylene, isobutene, and diisobutene are preferable. As the above olefin polysulfide, an olefin polysulfide containing 10 to 40% by weight of sulfur is preferable in view of the solubility, the stability, and the economy.

The above dialkyl polysulfide (3) is a compound represented by the general formula (VI):

$$R_6—S_x—R^7 \quad \text{(VI)}$$

(wherein $R^6$ and $R^7$ represent each an alkyl group having 1 to 20 carbon atoms, an aryl group having 6 to 20 carbon atoms, an alkylaryl group having 7 to 20 carbon atoms, or an arylalkyl group having 7 to 20 carbon atoms and may be the same or different, and x represents a real number (more specifically, a rational number) of 2 to 8.)

Specific examples of $R^6$ and $R^7$ in the above general formula (VI) include methyl group, ethyl group, n-propyl group, isopropyl group, n-butyl group, isobutyl group, sec-butyl group, t-butyl group, various types of pentyl group, various types of hexyl group, various types of heptyl group, various types of octyl group, various types of nonyl group, various types of decyl group, various types of dodecyl group, cyclohexyl group, cyclooctyl group, phenyl group, naphthyl group, tolyl group, xylyl group, benzyl group, and phenetyl group.

Examples of the dialkyl polysulfide include dibenzyl sulfide and di-t-nonyl polysulfide. Dialkyl polysulfides containing 10 to 40% by weight of sulfur are particularly preferable.

The above sulfurized oil and fat (4) is a sulfurized product of an animal or plant oil and fat, such as sulfurized lard, sulfurized rape seed oil, sulfurized castor oil, and sulfurized soy bean oil. The sulfurized oil and fat include disulfides of fatty acids, such as sulfurized oleic acid, and sulfurized esters, such as sulfurized methyl oleate. As the above sulfurized oil and fat, sulfurized oils and fats containing 5 to 25% by weight of sulfur are preferable. When the above olefin polysulfide, the above dialkyl polysulfide, or the above sulfurized oil and fat is used as component (C), the content of component (C) is generally selected in the range of 0.05 to 40% by weight, preferably in the range of 0.5 to 20% by weight, based on the total amount of the composition. When the content is less than 0.05% by weight, the synergistic effect or the additive effect with component (B) is not sufficiently exhibited. When the content is more than 40% by weight, corrosion and wear of tools take place to cause decrease in the life of the tools.

As the above sulfurized mineral oil (5), a commercial sulfurized oil may be used. A sulfurized mineral oil prepared by adding elemental sulfur (sulfur powder) to a conventional mineral oil and heating the resultant mixture, for example, at a temperature of about 120° to 150° C. for about 30 minutes to 6 hours while being stirred may also be used. It is preferred that the sulfurized mineral oil contains 0.1 to 2% by weight of sulfur.

When the above sulfurized mineral oil (5) is used as component (C), the content of the sulfurized mineral oil is generally selected in the range of 30 to 99.95% by weight based on the total amount of the composition. The sulfurized mineral oil may be used in place of the base oil.

The sulfurized mineral oil of component (C) includes active type oils and inactive type oils. Any of these oils may be used.

The cutting or grinding oil composition of the present invention may also comprise a perbasic alkali metal sulfonate and/or a perbasic alkaline earth metal sulfonate as component (D), where desired, in combination with component (A) and component (B) described above or in combination with component (A), component (B), and component (C).

As the perbasic alkali metal sulfonate and the perbasic alkaline earth metal sulfonate used for component (D), a potassium sulfonate, a sodium sulfonate, a calcium sulfonate, a magnesium sulfonate, and a barium sulfonate, having a base number (measured in accordance with the perchlorite method of Japanese Industrial Standard K-2501) in the range of 100 mg KOH/g or more, preferably in the range of 200 to 600 mg KOH/g, can be used. When the base number is less than 100 mg KOH/g, rust formation on a work which is caused by acidic substances formed by degradation during use cannot sufficiently be prevented. Moreover, there is the possibility that an oven used for disposal of the waste oil is damaged by corrosion.

Specific examples of component (D) include calcium petroleum sulfonates and sodium petroleum sulfonates having a base number of 300 mg KOH/g and calcium dialkylbenzenesulfonates and sodium dialkylbenzenesulfonates having a base number of 400 mg KOH/g. The perbasic alkali metal sulfonate and the perbasic alkaline earth metal sulfonate may be used singly or as a combination of two or more types. The content is generally selected in the range of 0.05 to 40% by weight, preferably in the range of 0.1 to 20% by weight, based on the total amount of the composition. When the content is less than 0.05% by weight, the synergistic or additive effect in combination with component (B) or in combination with component (B) and component (C) is not sufficiently exhibited. When the content is more than 40% by weight, the effect does not increase to the degree expected from the content, and unfavorable phenomena, such as increase in the viscosity and decrease in the storage stability of the composition, take place.

To the cutting or grinding oil composition of the present invention, various additives which are generally used in cutting oils and grinding oils can be used as component (E), where desired, within the range that the object of the present invention is not adversely affected.

Examples of the additive of component (E) which is used where desired include extreme pressure agents, such as chlorinated paraffins, chlorinated oils and fats, chlorinated fatty acids, esters of phosphoric acid, and esters of phosphorous acid; oiliness improvers, such as carboxylic acids such as oleic acid, stearic acid, and dimer acid, and esters of carboxylic acids; antiwear agents, such as zinc dithiophosphate (ZnDTP), zinc dithiocarbamate (ZnDTC), oxymolybdenum organophosphorodithioate sulfide (MoDTP), oxy-molybdenum dithiocarbamate sulfide (MoDTC), nickel dithiophosphate (NiDTP), and nickel dithiocarbamate (NiDTC); antioxidants, such as amine antioxidants and phenolic antioxidants; metal deactivators, such as thiadiazole and benzotriazole; sludge dispersants, such as alkenylsuccinic acids, esters of alkenylsuccinic acids, imides, and acid amides; corrosion inhibitors, such as sorbitane esters, neutral sulfonates, phenates, and salicylates of alkaline earth metals; and defoaming agents, such as dimethylpolysiloxane and fluoroethers.

The oil composition of the present invention is used as a cutting oil composition or a grinding oil composition. When the oil composition is used as a cutting oil composition, the oil composition can advantageously be used for working of holes, such as turning, tapping, reaming, broaching, drilling, and automatic lathe working. When the oil composition is used as a grinding oil composition, the oil composition is advantageously used, for example, for finish grinding, creep feed grinding, and ultra-finishing.

The present invention is described in more detail with reference to examples. However, the present invention is not limited by the examples.

The properties of the oil composition were evaluated in accordance with the following methods.

(1) Evaluation of the roughness of a finished surface and the life of a tool by the cutting experiment The cutting experiment was conducted by using an LP lathe produced by OKUMA TEKKOSHO Co., Ltd. as the machine, S45C and SUS 304 as the work (the life of a tool was evaluated using S45C alone), and an ultra-hard chip (K10) as the tool, under the cutting condition of v=20 m/min, f=0.025 mm/rev, and t=0.5 mm, and the roughness of the finished surface Rz (μm) and the life of the tool [as the distance (m) before the boundary wear reaches 0.3 mm] were obtained.

(2) Workability in tapping

Tapping was conducted by using a tapping torque tester (a product of FARREX Company) as the machine, OSG SKH51 (M10×P1.5) as the tap, and S20C and SUS 304 as the work, under the cutting condition of v=10 m/min. The tapping efficiency was obtained in accordance with the following equation:

$$\text{tapping efficiency (\%)} = (\text{amount of working of the sample oil} / \text{amount of working of the reference oil}) \times 100$$

(3) Roughness of the surface finished by broaching

Broaching was conducted by using a horizontal surface broach (a product of SANJO KIKAI Co., Ltd.) as the machine, SKH55 (16 blades) as the tool, and SCM435 as the work, under the cutting condition of v=12 m/min and t=0.5 mm, and the roughness of the finished surface Rz (μm) was obtained.

(4) Roughness of the surface finished by reaming

Reaming was conducted by using a machining center as the machine, SKH53 (with TiN coating) as the tool, and S20C as the work, under the cutting condition of v=20 m/min and f=0.15 mm/rev, and the roughness of the finished surface Rz (μm) was obtained.

EXAMPLES 1 TO 15 AND COMPARATIVE EXAMPLES 1 to 6

Cutting oil compositions and grinding oil compositions having formulations shown in Table 1 were prepared and evaluated. The results are shown in Table 2.

TABLE 1-1

| Example | 1 | 2 | 3 | 4 | 5 |
|---|---|---|---|---|---|
| composition (% by wt.) | | | | | |
| (A) base oil (mineral oil, 40° C., 15 cSt) | 89.7 | 94.7 | 94.2 | 89.7 | 84.7 |
| (B) di-n-butyl maleate | 10 | — | 5 | 5 | 5 |
| solution containing maleic acid[1] | — | 5 (0.5) | — | — | — |
| (maleic acid) | | | | | |
| di-n-butyl sebacate | — | — | — | — | — |
| (C) elemental sulfur | — | — | 0.5 | — | — |
| di-t-nonyl polysulfide | — | — | — | 5 | — |
| (D) perbasic Ca sulfonate (TBN[2] 400) | — | — | — | — | — |
| (E) chlorinated paraffin (chlorine content, 50 % by wt.) | — | — | — | — | 10 |
| purified soy bean oil | — | — | — | — | — |
| antioxidant, defoaming agent | 0.3 | 0.3 | 0.3 | 0.3 | 0.3 |

[1]An oleyl alcohol solution containing 10% by weight of maleic acid
[2]Total base number

TABLE1-2

| | Example 6 | 7 | 8 | 9 | Comparative Example 1 |
|---|---|---|---|---|---|
| composition (% by wt.) | | | | | |
| (A) base oil (mineral oil, 40° C., 15 cSt) | 79.7 | 84.7 | 64.2 | 89.7 | 89.7 |
| (B) di-n-butyl maleate | 5 | 5 | 30 | 5 | — |
| solution containing maleic acid[1] (maleic acid) | — | — | — | — | — |
| di-n-butyl sebacate | — | — | — | — | — |
| (C) elemental sulfur | — | — | 0.5 | — | — |
| di-t-nonyl polysulfide | 5 | 5 | — | — | 10 |
| (D) perbasic Ca sulfonate (TBN[2] 400) | — | 5 | 5 | 5 | — |
| (E) chlorinated paraffin (chlorine content, 50% by wt.) | 10 | — | — | — | — |
| purified soy bean oil | — | — | — | — | — |
| antioxidant, defoaming agent | 0.3 | 0.3 | 0.3 | 0.3 | 0.3 |

[1]An oleyl alcohol solution containing 10% by weight of maleic acid
[2]Total base number

TABLE 1-3

| Comparative Example | 2 | 3 | 4 | 5 | 6 |
|---|---|---|---|---|---|
| composition (% by wt.) | | | | | |
| (A) base oil (mineral oil, 40° C., 15 cSt) | 89.7 | 79.7 | 84.7 | 89.7 | 89.7 |
| (B) di-n-butyl maleate | — | — | — | — | — |
| solution containing maleic acid[1] (maleic acid) | — | — | — | — | — |
| di-n-butyl sebacate | — | — | — | — | 10 |
| (C) elemental sulfur | — | — | — | — | — |
| di-t-nonyl polysulfide | — | 5 | 5 | 5 | — |
| (D) perbasic Ca sulfonate (TBN[2] 400) | — | — | 5 | 5 | — |
| (E) chlorinated paraffin (chlorine content, 50% by wt.) | 10 | 10 | — | — | — |
| purified soy bean oil | — | 5 | 5 | — | — |
| antioxidant, defoaming agent | 0.3 | 0.3 | 0.3 | 0.3 | 0.3 |

[1]An oleyl alcohol solution containing 10% by weight of maleic acid
[2]Total base number

TABLE 2-1

| Example | 1 | 2 | 3 | 4 | 5 |
|---|---|---|---|---|---|
| properties | | | | | |
| cutting experiment | | | | | |
| roughness of finished surface, Rz (μm) | 3.6 | 3.3 | 2.9 | 3.1 | 2.7 |
| life of tool (m) | 1453 | 1389 | 1311 | 1305 | 1519 |
| tapping efficiency (%) | | | | | |
| S20C | 115 | 113 | 118 | 116 | 123 |
| SUS 304 | 118 | 120 | 117 | 115 | 133 |
| broaching roughness of finished surface, Rz (μm) | 5.19 | 4.93 | 4.52 | 4.75 | 3.72 |
| reaming roughness of finished surface, Rz (μm) | 3.2 | 2.9 | 1.8 | 2.8 | 1.9 |

TABLE 1-4

| Example | 10 | 11 | 12 | 13 | 14 | 15 |
|---|---|---|---|---|---|---|
| composition (% by wt.) | | | | | | |
| (A) base oil (mineral oil, 40° C., 15 cSt) | 84.7 | 84.7 | 84.7 | 89.7 | 89.7 | 89.7 |
| (B) di-n-octyl oxalate | 5 | — | — | 5 | — | — |
| di-2-ethylhexyl maleate | — | 5 | — | — | 5 | — |
| di-n-butyl citrate | — | — | 5 | — | — | 5 |
| (C) di-t-nonyl polysulfide | 5 | 5 | 5 | 5 | 5 | 5 |
| (D) perbasic Ca sulfonate (TBN[2] 400) | 5 | 5 | 5 | — | — | — |
| (E) antioxidant, defoaming agent | 0.3 | 0.3 | 0.3 | 0.3 | 0.3 | 0.3 |

[2]Total base number

TABLE 2-2

| | Example 6 | 7 | 8 | 9 | Comparative Example 1 |
|---|---|---|---|---|---|
| properties | | | | | |
| cutting experiment | | | | | |
| roughness of finished surface, Rz (μm) | 2.6 | 2.7 | 2.4 | 3.0 | 5.1 |
| life of tool (m) | 1355 | 1372 | 1401 | 1512 | 876 |
| tapping efficiency (%) | | | | | |
| S20C | 125 | 120 | 128 | 116 | 108 |
| SUS 304 | 133 | 118 | 131 | 117 | 104 |
| broaching roughness of finished surface, Rz (μm) | 3.60 | 4.11 | 3.44 | 4.99 | 6.38 |
| reaming roughness of finished surface, Rz (μm) | 1.9 | 4.1 | 3.6 | 3.3 | 6.8 |

TABLE 2-3

| Comparative Example | 2 | 3 | 4 | 5 | 6 |
|---|---|---|---|---|---|
| properties | | | | | |
| cutting experiment | | | | | |
| roughness of finished surface, Rz (μm) | 4.6 | 4.1 | 4.7 | 4.9 | 4.9 |
| life of tool (m) | 1291 | 1004 | 953 | 939 | 1250 |
| tapping efficiency (%) | | | | | |
| S20C | 106 | 111 | 110 | 109 | 106 |
| SUS 304 | 110 | 112 | 109 | 108 | 102 |
| broaching roughness of finished surface, Rz (μm) | 5.75 | 5.29 | 5.91 | 6.15 | 7.13 |
| reaming roughness of finished surface, Rz (μm) | 4.9 | 4.3 | 6.9 | 7.2 | 5.6 |

TABLE 2-4

| Example | 10 | 11 | 12 | 13 | 14 | 15 |
|---|---|---|---|---|---|---|
| properties | | | | | | |
| cutting experiment | | | | | | |
| roughness of finished surface, Rz (μm) | 2.6 | 2.7 | 2.8 | 3.0 | 3.2 | 3.2 |
| life of tool (m) | 1401 | 1388 | 1369 | 1335 | 1298 | 1287 |
| tapping efficiency (%) | | | | | | |
| S20C | 122 | 120 | 120 | 118 | 117 | 116 |
| SUS304 | 118 | 118 | 117 | 117 | 114 | 114 |
| broaching roughness of finished surface, Rz (μm) | 4.05 | 4.39 | 4.62 | 4.31 | 4.78 | 4.86 |
| reaming roughness of finished surface, Rz (μm) | 3.9 | 4.1 | 4.3 | 2.5 | 2.8 | 3.0 |

As can be understood from Table 2, the oil compositions of the present invention showed longer lives of tools, better precision of the finished surfaces, and superior workability of tapping than those in Comparative Examples.

INDUSTRIAL APPLICABILITY

The cutting or grinding oil composition increases working efficiency, such as suppressed wear of working tools and superior precision of a finished surface, and advantageously used as an oil for cutting, such as turning, tapping, reaming, broaching, drilling, or automatic lathe working.

I claim:

1. A cutting or grinding oil composition comprising (A) a base oil, (B) at least one compound selected from the group consisting of dibasic carboxylic acids having 2 to 6 carbon atoms, tribasic carboxylic acids having 3 to 6 carbon atoms, and ester derivatives of these dibasic and tribasic acids, and (D) at least one compound selected from the group consisting of perbasic alkali metal sulfonates and perbasic alkaline earth metal sulfonates, the base oil (A) being a mineral oil or a synthetic oil which is a branched olefin, a hydrogenation product of a branched olefin, a polyol ester or an alkyl benzene.

2. A cutting or grinding oil composition according to claim 1, wherein the dibasic acids for component (B) are oxalic acid and maleic acid and the tribasic acid for component (B) is citric acid.

3. A cutting or grinding oil composition according to claim 1, wherein component (B) is selected from the group consisting of dibasic acids and tribasic acids, and the content of component (B) is 0.05–20% by weight.

4. A cutting or grinding oil composition according to claim 1, wherein component (B) is selected from the group consisting of the ester derivatives of the dibasic acids and the tribasic acids, and the content of component (B) is 0.5–80% by weight.

5. A cutting or grinding oil composition comprising (A) a base oil, (B) at least one compound selected from the group consisting of dibasic carboxylic acids having 2 to 6 carbon atoms, tribasic carboxylic acids having 3 to 6 carbon atoms, and ester derivatives of these dibasic and tribasic acids, (C)

sulfur or a compound containing sulfur, and (D) at least one compound selected from the group consisting of perbasic alkali metal sulfonates and perbasic alkaline earth metal sulfonates, the base oil (A) being a mineral oil or a synthetic oil which is a branched olefin, a hydrogenation product of a branched olefin, a polyol ester or an alkyl benzene and the compound containing sulfur being a polysulfide or a sulfurized compound.

6. A cutting or grinding oil composition according to claim 5, wherein the dibasic acids for component (B) are oxalic acid and maleic acid and the tribasic acid for component (B) is citric acid.

7. A cutting or grinding oil composition according to claim 5, wherein component (B) is selected from the group consisting of dibasic acids and tribasic acids, and the content of component (B) is 0.05–20% by weight.

8. A cutting or grinding oil composition according to claim 5, wherein component (B) is selected from the group consisting of the ester derivatives of the dibasic acids and the tribasic acids, and the content of component (B) is 0.5–80% by weight.

9. A method comprising the step of turning, tapping, reaming, broaching, drilling, or automatic lathe working a metal in the presence of a cutting or grinding oil composition according to claim 1.

10. A method comprising the step of turning, tapping, reaming, broaching, drilling, or automatic lathe working a metal in the presence of a cutting or grinding oil composition according to claim 5.

* * * * *